United States Patent [19]

Marsh et al.

[11] Patent Number: 4,852,188

[45] Date of Patent: Aug. 1, 1989

[54] PANTY-TYPE GARMENTS WITH SECURITY POCKET

[75] Inventors: Renee H. Marsh, Wallburg; Regina H. Henderson, Trinity; Earle W. Rearwin, Archdale, all of N.C.

[73] Assignee: It's A Peach, Inc., High Point, N.C.

[21] Appl. No.: 167,848

[22] Filed: Mar. 14, 1988

[51] Int. Cl.[4] ..... A41D 27/20; D04B 9/46; A41B 9/04

[52] U.S. Cl. ..... 2/250; 66/172 E; 66/177; 2/409

[58] Field of Search ..... 2/250, 247, 239, 406, 2/407, 403, 404, 409; 66/172 E, 177, 41

[56] References Cited

U.S. PATENT DOCUMENTS

| | | | |
|---|---|---|---|
| 767,381 | 8/1904 | Brown | 2/239 |
| 1,599,687 | 9/1926 | Sullivan | 2/247 |
| 2,814,807 | 12/1957 | Dollar . | |
| 2,840,824 | 7/1958 | Horner | 2/247 |
| 2,890,461 | 6/1959 | Hartman et al. . | |
| 2,953,003 | 9/1960 | Crawford | 66/41 |
| 3,396,264 | 8/1968 | Murphy et al. . | |
| 3,729,956 | 5/1973 | Nebel et al. | 66/172 E |
| 3,777,313 | 12/1973 | Bergsten et al. | 2/250 X |
| 4,005,494 | 2/1977 | Burn . | |
| 4,038,699 | 8/1977 | Burn . | |
| 4,069,514 | 1/1978 | Palmieri et al. | 2/247 X |
| 4,150,554 | 4/1979 | Cassidy, Sr. | 66/177 X |
| 4,445,233 | 5/1984 | Rubin . | |
| 4,663,946 | 5/1987 | Wright | 66/177 |

*Primary Examiner*—H. Hampton Hunter

*Attorney, Agent, or Firm*—Shefte, Pinckney & Sawyer

[57] ABSTRACT

A security pocket formed at the waistband of a woman's pantyhose or like undergarment for the secure storage of valuables, e.g. a credit card, currency, keys, or identification. The pocket includes an interior flap for retaining such stored items within the pocket. The flap may be knitted with an uncovered elastomer yarn partially exposed at a surface of the flap facing the body of the garment to provide frictional adhering contact therewith for added security.

8 Claims, 1 Drawing Sheet

PANTY-TYPE GARMENTS WITH SECURITY POCKET

BACKGROUND OF THE INVENTION

The present invention relates generally to women's undergarments of the basic type having a panty portion, e.g. pantyhose, panties, and the like, and to such a garment provided with a security pocket for storage of valuables.

Women's undergarments of the type worn about the lower trunk of the body may take a variety of conventional forms ranging from a pair of panties or like under pants, panty girdles, traditional girdles, etc. In recent years, ladies' pantyhose garments, basically a combination panty and pair of stockings unitarily formed, have become widely popular throughout the United States and elsewhere in the world, virtually eliminating the previously conventional use of individual stockings and garter belts or like stocking supporters. Conventionally, pantyhose garments are basically formed of a pair of tubular hosiery blanks typically knitted on a conventionally circular hosiery knitting machine. Each hosiery blank is slit longitudinally at one end and the raw fabric edges exposed by the slits are seamed together along a generally U-shaped seam line.

Inasmuch as all such garments are designed to be worn beneath outer garments and clothing, such undergarments have never been designed nor intended to be adapted for carrying personal items of the wearer. On the other hand, a growing concern of women is the security of routinely-carried personal items and valuables such as currency, credit cards, keys, identification, etc. and accordingly, a need exists for conventional women's wearing apparel to provide secure storage for such items.

SUMMARY OF THE INVENTION

It is accordingly an object of the present invention to provide an improved woman's undergarment of the type having a panty portion with a waistband wherein a pocket is formed in the panty portion at the waistband for defining an enclosure for security storage of valuables. According to the present invention, the pocket has a flap which extends inwardly within the enclosure for retaining stored valuables within the enclosure. Preferably, the pocket of the present invention is incorporated in the panty portion of a pair of woman's pantyhose, although the pocket may be equally well adapted to any other conventional type of undergarment having a panty portion.

According to the preferred embodiment of the present invention, the pocket is open at the extent of the enclosure along the waistband of the panty portion and is closed along the remaining extent of the enclosure, with the retaining flap extending along the open extent of the pocket.

The retaining flap is constructed to generally adhere to the panty portion for generally closing the pocket. For this purpose, the flap includes an uncovered elastomer yarn partially exposed at a surface of the flap facing the panty portion for adhering contact therewith. For example, the flap may be of a knitted fabric construction having yarn formed in stitches extending in perpendicular courses and wales including the uncovered elastomer yarn knitted in selected courses in alternating knit and float stitches with the float stitches appearing at the facing surface of the flap. It is further preferred that each selected course of the flap includes another yarn knitted in plated relationship with the uncovered elastomer yarn.

The waistband of the panty portion is preferably of a turned welt construction with its surface facing the flap being formed of a corresponding knitted construction as the facing surface of the flap to similarly include an uncovered elastomer yarn partially exposed at the waistband surface facing the flap for contact therewith.

DESCRIPTION OF THE PREFERRED EMBODIMENT

Figure 1:
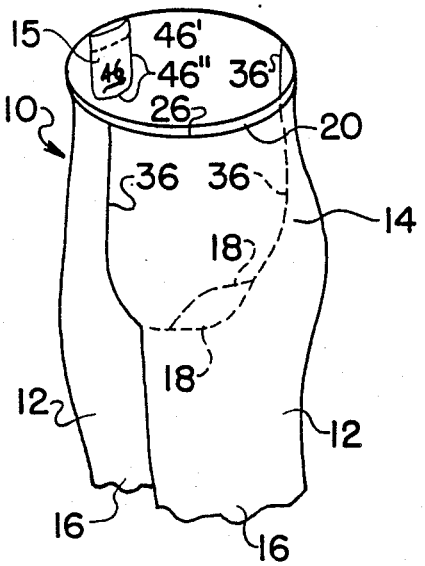
FIG. 1 is a perspective view of a typical pantyhose garment in which the security pocket of the present invention is preferably embodied.

Referring now to the accompanying drawings and initially to FIG. 1, a typical pantyhose garment of the type in which the security pocket of the present invention is preferably embodied is indicated generally at 10 and basically includes a pair of individual hosiery stocking blanks 12 sewn together at the upper portions thereof to form a pair of underpanties 14 unitarily with a pair of leg stockings 16. As desired, a diamond-shaped dual-thickness crotch panel 18 may be sewn between the stocking blanks 12 in the crotch area of the underpanties 14. Each of the hosiery blanks 12 is formed at its respective upper end with a dual ply welt, which welts cooperate in the pantyhose garment 10 to form an elasticized waistband annularly along the upper edge of the underpanties 14, as indicated at 20. According to the present invention, a security pocket, indicated generally at 15, is provided at the radially inward face of the underpanties 14 along the waistband 20 for storage of small personal items, valuables and the like. Each of the pocket 15 and the waistband 20 are preferably of a particular construction, as more fully described hereinafter.

Figure 2:
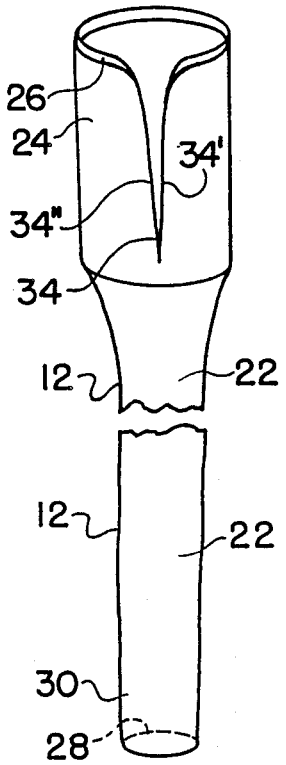
FIG. 2 is a perspective view of a typical hosiery blank for use in forming the pantyhose garment of FIG. 1.

As best seen in FIG. 2, each of the hosiery blanks 12 is of a tubular circulary-knitted construction having a tubular lower leg portion 22, a tubular upper panty portion 24 integrally knitted with the upper end of the leg portion 22, and an annular welt-type waistband portion 26 integrally knitted with the upper end of the panty portion 24. The lower end of the leg portion 22 of each hosiery blank 12 is sewn closed at 28 to form a foot portion 30 at the lower end of the leg portion 22. The present invention does not concern the construction of the leg and panty portions 22,24, which may be of any conventional knitted construction desired, preferably utilizing a typical stretchable synthetic yarn such as a texturized nylon yarn. The knitted construction of the security pocket 15 and of the waistband portion 26 of each hosiery blank 12 in accordance with the present invention is described more fully hereinafter.

In conventional manner, the pantyhose garment 10 is produced by initially forming an axial slit 34 in each hosiery blank 12 extending through its waistband 26 and panty portion 24, thereby exposing ront and rear edges 34',34" of the slit 34. The slit 34 in each hosiery blank 12 is opened with its front and rear edges 34',34" oriented generally in line with one another in a continuous U-shape. The crotch panel 18 is sewn along one side thereof to one of the hosiery blanks 12 along the juncture of its front and rear edges 34',34". Then, the pair of hosiery blanks 12 are arranged with their respective front and rear slit edges 34',34" juxtaposed and the slit edges 34',34" are sewn together along a U-shaped seam 36, with the exposed longitudinal edge of the crotch panel 18 being sewn along the juncture of the front and rear slit edges 34',34" of the other hosiery blank 12 in the process.

In generally conventional manner, each hosiery blank 12 is preferably knitted on a circular knitting machine which may be of any suitable multi-feed type commonly known within the industry. Such knitting machines basically include a rotatable needle cylinder of a relatively small diameter with axial needle slots formed at a fine-gauge spacing from one another about the outer circumferential surface of the cylinder. A plurality of latch-type knitting needles, each having a yarn receiving hook and a closeable latch assembly, are reciprocably disposed within the axial cylinder slots. A sinker ring having a plurality of radial slots formed at compatible spacings thereabout is disposed annularly and coaxially about the upper end of the needle cylinder for synchronous rotation therewith. A plurality of loop-forming sinkers are reciprocably carried in the radial slots of the sinker ring for movement of the sinkers transversely of and between the cylinder needles. Similarly, a circular dial plate having a corresponding plurality of compatibly-spaced radial slots thereabout is disposed coaxially at the upper end of the needle cylinder to also rotate synchronously with the cylinder and sinker ring. A plurality of transfer jacks are reciprocably carried in the radial slots of the dial for movement transversely of the cylinder needles in opposition to the sinkers.

Preferably, the knitting machine has four knitting stations at which yarn feeding fingers or other feeding instruments are positioned for movement into and out of yarn feeding disposition adjacent the upper end of the needle cylinder to feed yarn to the needles and sinkers thereat. The needles, sinkers and transfer jacks are operatively manipulated within the respective slots of the cylinder, sinker ring and dial by stationary cams positioned adjacent each thereof to engage and act on cam butts formed respectively on the needles, sinkers and transfer jacks during the synchronous rotation of the needle cylinder, sinker ring and dial.

In conventional manner, the knitting machine is operable to carry out the knitting of each hosiery blank 12 from its waistband portion 26 to the foot portion 30 and an appropriate control drum or similar control arrangement of a conventional construction is provided on the machine for determining the necessary transitional changes in the machine operation to form each portion of the hosiery blank 12.

For the knitting of hosiery blanks 12 according to the present invention, the knitting machine is initially set up with one yarn feeding finger at each of the four knitting stations of the machine being equipped with an appropriate body yarn, e.g., a texturized low denier nylon yarn, for knitting of the leg and panty portions 22,24 as well as for selective knitting in the waistband portion 26 as hereinafter described. In addition, a designated one of the knitting stations is set up with another of its yarn feeding fingers equipped with an uncovered elastomer filamentary yarn and with a third yarn feeding finger equipped with a covered elastomer yarn, for feeding operation to the needles and sinkers during the knitting of the waistband portion 26 as hereinafter described.

As used herein, the term elastomer is intended and used in a generic sense to identify any rubber or plastic material, whether synthetic or natural, having sufficient qualities of stretchability and resiliency and being suitable for formation in elongate continuous filaments for knitting, weaving or other use in the fabrication of textile fabrics. By way of example and without limitation, any common spandex filament currently in use in the knitting industry may be utilized as the uncovered elastomer yarn, such as "Glospan" spandex yarn produced by Globe Manufacturing Co., "Lycra" spandex filament produced E.I. DuPont de Nemours Co., or any other uncovered latex filament. The preferred covered elastomer yarn is of the same type of spandex filament covered by wrapping, braiding or similar manner with another yarn or fiber such as conventional core spun yarns.

In the knitting of each hosiery blank 12, the waistband portion 26 is knitted by initially activating the nylon yarn feeding finger at each knitting station and simultaneously activating and manipulating all cylinder needles, sinkers and dial transfer jacks for forming several so-called make-up single jersey stitch courses on the transfer jacks, whereupon the jacks are withdrawn into the dial and deactivated until the completion of the welt construction of the waistband, all in conventional manner. Following completion of the make-up courses on the transfer jacks, the nylon yarn feeding finger at the one designated knitting station is taken out of feeding operation and the feeding finger carrying the covered elastomer filament is activated for feeding operation. As the rotation of the needle cylinder and sinker ring continues, only every alternate cylinder needle and the alternating sinkers associaated therewith are activated and manipulated at the one designated knitting station, while all cylinder needles and sinkers continue to be activated and manipulated at the other three knitting stations. Accordingly, during each subsequent revolution of the needle cylinder and sinker ring, three successive courses of nylon body yarn are formed in single jersey stitch construction followed by one course of the covered elastomer yarn formed in jersey stitches in alternate needle wales and float stitches across intermediate needle wales. This manner of operation is continued for a predetermined number of revolutions of the needle cylinder and sinker ring, e.g. seven revolutions sufficient to form twenty-eight fabric courses.

Thereupon, the yarn feeding finger at the one designated knitting station carrying the uncovered elastomer filament is activated into yarn feeding position while the yarn feeding finger carrying the covered elastomer at the designated station is maintained in feeding operation for simultaneous feeding of both elastomer yarns. Needle manipulation at the four knitting stations continues identically as in the immediately preceding revolutions of the needle cylinder and sinker ring. Accordingly, during each continuing revolution of the needle cylinder and sinker ring, three successive nylon body yarn courses are formed each of a single jersey stitch construction followed by one course of the covered and uncovered elastomer yarns formed in plated relationship in jersey stitches in alternate needle wales and in float stitches across the intermediate needle wales. This manner of operation is continued for a predetermined number of revolutions of the needle cylinder and sinker ring, e.g. seven revolutions thereby forming twenty-eight successive fabric courses in total.

Following the completion of the predetermined number of cylinder and sinker ring revolutions, the knitting machine is returned to the preceding operating condition wherein the one designated knitting station has only its yarn feeding finger carrying the covered elastomer yarn in feeding position with the nylon yarn feeding finger and the yarn feeding finger carrying the uncovered elastomer yarn out of feeding operation. Manipulation of the needles and sinkers continues identically as during all of the cylinder and sinker ring revolutions subsequent to the make-up courses. This operating condition of the machine then continues for approximately the same number of machine revolutions previously occurring since the completion of the make-up courses, e.g. fourteen revolutions, thereby to form substantially the same fabric extent as already knitted in a repeating pattern of three successive nylon yarn jersey stitch courses alternating with one intervening covered elastomer course in alternating jersey and float stitches.

Following the completion of such revolutions of the cylinder and sinker ring, the yarn feeding finger carrying the covered elastomer yarn at the one aforesaid knitting station is removed from feeding operation and replaced by the nylon yarn feeding finger and, simultaneously, the transfer jacks in the dial are reactivated to return the make-up courses onto the cylinder needles. Thus, as the needle cylinder and sinker ring revolutions continue thereafter, the welt construction of the waistband portion 26 is completed and the formation of the panty portion 24 and, subsequently, the lower leg portion 22 progresses in a conventional fashion.

Figure 3:
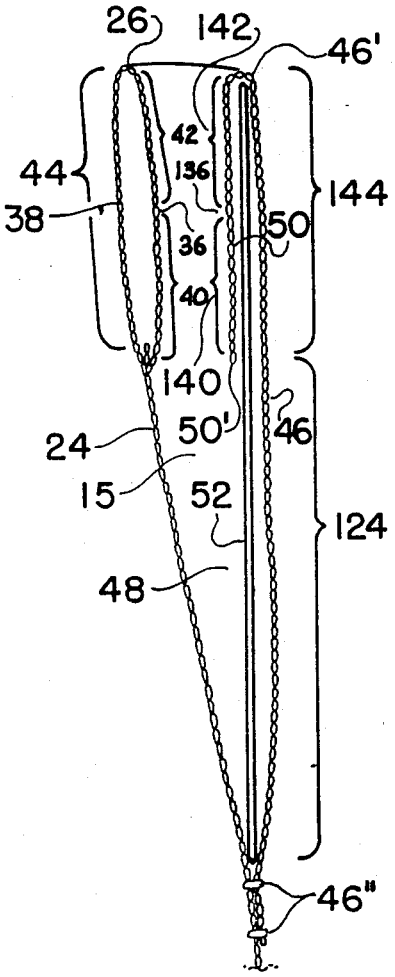
FIG. 3 is a diagrammatic vertical sectional view through the waistband and the security pocket of the pantyhose garment of FIG. 1.

As will thus be understood, the waistband portion 26 of each hosiery blank 12 is of a two-ply in turned welt construction as diagrammatically represented schematically in FIG. 3, having a radially inwardly facing fabric ply 36 formed during the initial fourteen (or other predetermined number) revolutions of the needle cylinder and sinker ring in the formation of the waistband welt following the completion of the initial make-up courses and a radially outwardly facing fabric ply 38 formed during the succeeding fourteen cylinder and sinker ring revolutions in the formation of the waistband welt. As will further be understood, the abovedescribed group of yarn courses initially formed immediately following the make-up courses wherein three succeeding nylon jersey courses alternate repetitively with a single intervening covered elastomer course of alternating jersey and float stitches, appears in the radially inward ply 36 at its region adjacentmost the panty portion 24, as indicated at 40 in FIG. 3. The subsequently-formed group of yarn courses wherein three succeeding nylon jersey courses alterntate according to the same pattern with a single intervening plated course of covered and uncovered elastomer filaments in the same alternating jersey and float stitch construction, also appears in the radially inwardly facing ply 36 at the annular region thereof along the upper edge of the waistband portion 26, as indicated at 42 in FIG. 3. The succeedingly formed group of yarn courses identical in repeating pattern to the courses of region 40 occupy the entire radially outward ply 38, as indicated at 44 in FIG. 3.

The pocket 15 of the pantyhose 10 is formed by sewing a generally rectangular section 46 of knitted fabric to the inward face of the panty portion 14, with one of the shorter sides of the fabric section 46 extending unattached along the waistband 20 as indicated at 46' and with a seam, preferably a double seam, being sewn along the remaining three sides of the fabric section 46 to attach it to the panty portion 14 as indicated at 46''. In this manner, the pocket 15 defines an enclosure 48 between the fabric section 46 and the adjacent facing section of the panty portion 14, the enclosure 48 being open at its extent along the waistband 20 while being closed along the remaining extent of the enclosure 48.

According to the present invention, the pocket 15 is provided with an interior retaining flap 50 formed integrally with the fabric section 46 as a fold thereof extending inwardly into the pocket enclosure 48 along the unattached side 46' of the fabric section 46 at the open extent of the enclosure 48. The inwardly disposed edge 50' of the flap 50 is unattached to the adjacent extent of the fabric section 46 to remain free thereof permitting the flap 50 to be positioned over articles inserted into the pocket 15 to retain such articles between the flap 50 and the main body of the fabric section 46 for added security, as representatively shown in FIG. 3 by the credit card 52 positioned within the pocket 15.

Advantageously, the fabric section 46 is cut from a circularly knitted fabric formed in nearly identical fashion to the panty and waistband portions 24,26 of a hosiery blank 12 as described above, except that the initially-knitted extent of the circular fabric utilized for the fabric portion 46 is not knitted of a two-ply inturned welt construction. Specifically, fabric for the pocket section 46 is circularly knitted by initially forming a series of 28 fabric courses identical to the group of courses 40, wherein three succeeding nylon jersey courses alternate repetitively with a single intervening covered elastomer course of alternating jersey and float stitches, as indicated at 140 in FIG. 3. In contrast, however, no make-up courses in the fabric section 140 are formed on the transfer jacks of the knitting machine. Next, a succeeding group of 28 yarn courses are formed identically to the group of courses 42, wherein three succeeding nylon jersey courses alternate in the same pattern with a single intervening plated course of covered and uncovered elastomer filaments in the same alternating jersey and float stitch construction, as indicated at 142 in FIG. 3. Then, a succeeding group of 56 yarn courses are formed identically to the group of courses 44 in the same repeating pattern as the courses of the fabric region 140, as indicated at 144 in FIG. 3, followed by the formation of an uninterrupted series of succeeding nylon jersey courses identically to the panty portion 24, as indicated at 124 in FIG. 3.

As will be understood, since no make-up courses of the initial fabric region 140 are formed on the transfer jacks of the knitting machine, the circularly knitted fabric thusly formed for the pocket section 46 is knitted as a continuous tubular length of fabric without formation of a two-ply inturned welt. The rectangular section of fabric 46 for the pocket 15 is cut from the initially-knitted axial end of this fabric and, preparatory to the sewing of the cut fabric section 46 to the pantyhose 10, the initially-knitted end of the fabric section 46 is folded along the juncture between the regions 142 and 144 to form the flap 50 of the fabric regions 140,142 with the technical reverse, or so-called "purl," side of the knitted fabric in the fabric regions 140,142 facing outwardly. The pocket section 46 is then placed in the aforementioned disposition at the inward face of the panty portion 14 of the pantyhose 10 with the fabric regions 140,142 in opposed facing relationship to the corresponding fabric regions 40,42 of the waistband portion 20 of the pantyhose 10. The fabric section 46 is then sewn along its sides 46" to the panty portion 14 to form the pocket 15.

Figure 4:
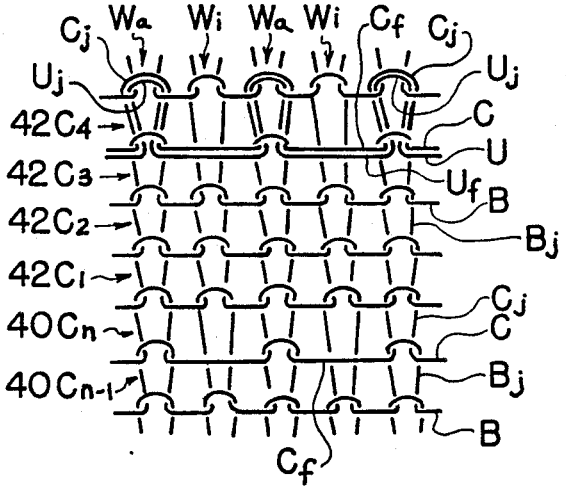
FIG. 4 is a diagrammatic elevational view of the knitted structure of both the radially inward ply of the waistband and the radially outward ply of the security pocket of FIG. 3 in accordance with the preferred embodiment of the present invention.

Referring now to FIG. 4, the knitted construction of the inward ply 36 of the waistband portion 26 of each hosiery blank 12 is diagrammatically illustrated in elevation across several courses of the annular regions 40,42 as appearing at the exposed radially inwardly facing side of the ply 38. It will of course be understood that the knitted construction of the flap 50 of the pocket fabric section 46 at the juncture of its fabric regions 140,142 is also identical to FIG. 4. As will be understood by those persons skilled in the art, the technical reverse, or so-called "purl", side of the knitted fabric in the waistband portion 26 appears at the exposed face of both the inward and outward fabric plies 36,38, as depicted in FIG. 4. Similarly, as stated above, the technical reverse side of the flap 50 faces the inward ply 36 of the waistband portion 26. In FIG. 4, courses $40C_n$ and $40C_{n-1}$ represent the final two courses knitted in the region 40 (and in the region 140 of the flap 50), course $40C_{n-1}$ representing a nylon jersey stitch course having the nylon body yarn B knitted in jersey knit stitches $B_j$ in every axial wale $W_a$, $W_i$ throughout the circumferential extent of the waistband portion 26 and course $40C_n$ representing a covered elastomer yarn course having the covered elastomer filament C formed in jersey knit stitches $C_j$ in alternate fabric wales $W_a$ and in intervening float stitches $C_f$ across the intermediate wales $W_i$ throughout the circumferential extent of the waistband portion 26. Similarly, courses $42C_1$ through $42C_4$ represent the first four fabric courses of the repeating course pattern through the region 42 of the inward ply 36 (and the region 142 of the flap 50), courses $42C_1$ through $42C_3$ representing nylon jersey courses identical to the nylon courses of the region 40 such as course $40C_{n-1}$, and course $42C_4$ representing the plated courses of the region 42 having the covered elastomer yarn C and the uncovered elastomer yarn U knitted in plated relationship in respective jersey knit stitches $C_j$,$U_j$ in every alternate wale $W_a$ and in respective float stitches $C_f$;$U_f$ extending across every intermediate fabric wale $W_i$ throughout the circumferential extent of the waistband portion 26. According to the present invention, the covered and uncovered elastomer filaments C,U appear in their plated relationship with only the uncovered filament U appearing at the technical back side of the knitted fabric so as to appear at the radially inward face of the inward ply 36 (and, similarly, at the outward face of the flap 50) and with only the covered elastomer filament C appearing at the technical face side of the fabric to appear at the unexposed radially outward face of the inward ply 36 (and at the unexposed surface of the flap 50). Both the covered and uncovered filaments C,U appear in the diagrammatic illustration of FIG. 4 solely for purposes of illustration and explanation of the plated relationship of such filaments, it being understood as described that only the uncovered filament U would appear from such view in the actual fabric.

The knitted construction of the plate courses in the region 42 of the inward welt ply 36 provides the waistband portion 26, and in turn the waistband 20 in pantyhose and like garments in which such waistband portions are incorporated, with distinct and unique advantages over conventional knitted waistband constructions. As will be understood, the elastomeric material of which the uncovered elastomer filament is constituted produces significant frictional forces when in contact with other surfaces. As will be further understood, the float stitches $U_f$ of the uncovered elastomer filament U produced by the alternating float construction of the plated elastomer filament courses in the region 42 of the inward welt ply 36 expose a significant extent of the uncovered elastomer filament at the radially inwardly facing surface of the inward ply 36. Accordingly, when the pantyhose 10 is worn the uncovered elastomer filament floats $U_f$ at the inward side of the waistband 20 naturally come into direct frictional contact either with the wearer's skin at the waist or with another undergarment if worn by the wearer, such as a pair of panties as ordinarily worn by women beneath a pantyhose garment. The frictional forces thusly created by the uncovered elastomer floats $U_f$ substantially resist any tendency of the waistband 20 to shift or slip during wearing as a result of the physical activities of the wearer, in significant contrast to conventional pantyhose waistbands. As an attendant advantage, the waistband 20 may be less elastically constricting and binding than conventioanl pantyhose while still achieving an improved ability to remain in place when worn, thereby providing enhanced comfort for the wearer without sacrificing a firm fit.

Similar advantages are realized as a result of the exposed float stitches $U_f$ of the uncovered elastomer filaments U appearing respectively in the facing surfaces of the region 42 of the inward welt ply 36 of the waistband and in the corresponding region 142 of the flap 50 of the pocket fabric section 46. When the pantyhose 10 is worn, the uncovered elastomer filament floats $U_f$ in the respective fabric regions 42,142 are caused to come into direct frictional contact with the fabric of the facing region 142,42, and, as above described, such frictional contact tends to cause the retaining flap 50 and the waistband 20 to generally adhere to one another so as to resist shifting or slippage with respect to each other during wearing. As a result, the pocket 15 naturally remains essentially closed along the opening thereinto at the waistband to provide added security in retaining items carried within the pocket enclosure 48. Thus, the pocket 15 provides a convenient and secure location for the carrying of a reserve credit card or currency, an extra key, emergency identification, etc.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the forgoing description thereof, without departing from the substance or scope of the present invention. For example and without limitation, the present invention may be embodied in waistbands in many garments other than pantyhose as well as in knitted bands having other uses in other garments such as in elastic tops for socks and hosiery, elastic cuffs, elastic shoulder straps in brassieres, slips and the like. Further, it is contemplated that elastic bands according to the present invention may be equivalently fabricated by warp knitting machinery and methods as well as by circular or weft knitting as above described. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangemnts, the present invention being limited only by the claims appended hereto and the equivalents thereof.

We claim:

1. In a woman's pantyhose, panty and any like undergarment having a panty portion with a waistband, the improvement comprising a pocket formed in said panty portion at said waistband for defining an enclosure for security storage of valuables, said pocket being open at the extent of said enclosure along said waistband of said panty portion and closed along the remaining extent of said enclosure, said pocket having a flap extending inwardly within said enclosure along said open extent of said pocket for retaining stored valuables within said enclosure, one of said waistband and said flap including means for generally adhering to the other for generally closing said pocket, said adhering means including an uncovered elastomer yarn partially exposed at a surface of said one of said waistband and said flap facing the other thereof for adhering contact therewith.

2. The improvement in a woman's undergarment according to claim 8 and characterized further in that said flap is of a knitted fabric construction having yarn formed in stitches extending in perpendicular courses and wales including said uncovered elastomer yarn knitted in selected courses in alternating knit and float stitches with the float stitches appearing at said facing surface of said flap.

3. The improvement in a woman's undergarment according to claim 2 and characterized further in that each said selected course of said flap includes another yarn knitted in plated relationship with said uncovered elastomer yarn.

4. The improvement in a woman's undergarment according to claim 8 and characterized further in that said waistband includes a second uncovered elastomer yarn partially exposed at a surface of said waistband facing said flap for contact therewith.

5. The improvement in a woman's undergarment according to claim 4 and characterized further in that said facing surface of said waistband is of a knitted fabric construction having yarn formed in stitches extending in perpendicular courses and wales including said second uncovered elastomer yarn knitted in selected courses in alternating knit and float stitches with the float stitches appearing at said facing surface of said waistband.

6. The improvement in a woman's undergarment according to claim 5 and characterized further in that each said selected course of said waistband includes another yarn knitted in plated relationship with said uncovered elastomer yarn.

7. The improvement in a woman's undergarment according to claim 6 and characterized further in that said waistband is of a turned welt construction.

8. The improvement in a woman's undergarment according to claim 1 and characterized further in that said flap includes said adhering means.

* * * * *